US010563289B2

(12) United States Patent
Sernik et al.

(10) Patent No.: US 10,563,289 B2
(45) Date of Patent: Feb. 18, 2020

(54) PROCESS FOR REFINING NIOBIUM-BASED FERROALLOYS

(71) Applicant: Companhia Brasileira de Metalurgia e Mineração, Araxá (BR)

(72) Inventors: Kleber A. Sernik, Greensburg, PA (US); Clovis Antonio De Faria Sousa, Araxá (BR); Eduardo Augusto Ayroza Galvão Ribeiro, São Paulo (BR)

(73) Assignee: Companhia Brasileira de Metalurgia e Mineracão, State Of Minas Gerais (BR)

( * ) Notice: Subject to any disclaimer, the term of this patent is extended or adjusted under 35 U.S.C. 154(b) by 239 days.

(21) Appl. No.: 15/695,551

(22) Filed: Sep. 5, 2017

(65) Prior Publication Data

US 2019/0003012 A1 Jan. 3, 2019

Related U.S. Application Data

(63) Continuation-in-part of application No. 15/638,098, filed on Jun. 29, 2017.

(51) Int. Cl.

| | |
|---|---|
| ***C22B 34/24*** | (2006.01) |
| ***C22B 5/04*** | (2006.01) |
| ***C22C 33/00*** | (2006.01) |
| ***C22C 35/00*** | (2006.01) |
| ***C22B 1/24*** | (2006.01) |
| ***C22B 4/06*** | (2006.01) |
| ***C22B 5/16*** | (2006.01) |
| ***C22B 9/04*** | (2006.01) |
| ***C22C 27/02*** | (2006.01) |

(52) U.S. Cl.

CPC ..... *C22B 34/24* (2013.01); *C22B 1/24* (2013.01); *C22B 4/06* (2013.01); *C22B 5/04* (2013.01); *C22B 5/16* (2013.01); *C22B 9/04* (2013.01); *C22C 27/02* (2013.01); *C22C 33/00* (2013.01); *C22C 35/005* (2013.01)

(58) Field of Classification Search

CPC ..... C22B 34/24; C22B 5/04; C22B 9/003; C22B 9/04; C22B 33/04

See application file for complete search history.

(56) References Cited

U.S. PATENT DOCUMENTS 3,784,369 A * 1/1974 Svanstrom ..... B22F 9/16 75/363

FOREIGN PATENT DOCUMENTS

| | | | |
|---|---|---|---|
| CN | 101353726 A | | 1/2009 |
| CN | 101565779 A | | 10/2009 |
| CN | 102251126 A | | 11/2011 |
| CN | 102357504 A | | 2/2012 |
| CN | 103397200 A | | 11/2013 |
| CN | 103498058 A | | 1/2014 |
| CN | 106191639 | * | 12/2016 |
| CN | 106191639 A | | 12/2016 |
| JP | 2005-81243 | * | 3/2005 |
| JP | 2005081243 A | | 3/2005 |
| RU | 2269585 C1 | | 2/2006 |
| WO | WO-2013/086990 A1 | | 6/2013 |

OTHER PUBLICATIONS

Sattelberger et al, "Production of High Purity Niobium Mater Alloys", Niobium Science & TechnologyProceedings of the International Symposium Niobium 2001, Dec. 2-5, 2001, pp. 97-104.*

Sattelberger, S., et al., "Production of High Purity Niobium Master Alloys", Niobium, Science & Technology: Proceedings of the International Symposium Niobium 2001, Orlando, Florida, U.S.A. Dec. 2-5, 2001, Published by Niobium 2001 Ltd., Bridgeville, PA, pp. 97-104; also available at: https://www.gfe.com.fileadmin/user_upload/pdfs/Veroeffentlichungen/Master%20Alloys_HPNbMasteralloys.pdf.

Mehra, O.K. et al., "Production of Ferro-Niobium", Transactions of the Indian Institute of Metals, Calcutta, India, vol. 24, No. 1, Feb. 28, 1971, pp. 66-70.

Sousa, C. A. de Faria, "The Eveloution of FeNb Manufacutring", Niobium, Science & Technology: Proceedings of the International Symposium Niobium 2001, Orlando, Florida, U.S.A. Dec. 2-5, 2001, Published by Niobium 2001 Ltd., Bridgeville, PA, pp. 89-96.

DeFuccio, R. Jr., et al., "A Semi-Continuous Autothermic Reduction Process for the Production of Ferroniobium", INFACON 6, Proceedings of the 6th International Ferraoalloy Congress, Cape Town, vol. 1, Johannesburg, SAIMM, 1992, pp. 279-283.

PCT International Search Report and Written Opinion dated Oct. 8, 2018, issued during the prosecution of PCT International Patent Application No. PCT/IB2018/054824, 10 pages.

* cited by examiner

*Primary Examiner* — C Melissa Koslow

(74) *Attorney, Agent, or Firm* — Locke Lord LLP; Alicia J. Carroll

(57) ABSTRACT

Refined niobium-based ferroalloys are provided by removing lead and other impurities therefrom by a process comprising charging niobium ore concentrate and/or niobium oxide or a mixture of niobium oxides to a metallothermic reaction chamber, admixing the ore concentrate and/or niobium oxide with a reducing agent, initiating a metallothermic reaction, under reduced pressure; and allowing the reaction product to solidify and cool; crushing the reaction product or crushing the niobium-based ferroalloy previously reduced in open air, and charging the crushed product to a melting crucible within a vacuum induction melting furnace, lowering the pressure within the furnace to below 1 mbar, and melting the crushed product while vaporizing the impurities contained therein.

18 Claims, 2 Drawing Sheets

PROCESS FOR REFINING NIOBIUM-BASED FERROALLOYS

CROSS-REFERENCE TO RELATED APPLICATIONS

The present application claims priority to and is a continuation-in-part application of U.S. patent application Ser. No. 15/638,098 filed on Jun. 29, 2017, the entire contents of which is incorporated herein by reference.

BACKGROUND OF THE INVENTION

1. Field of the Invention

This invention relates to niobium-based ferroalloys and processes for refining such alloys to safely eliminate impurities therefrom.

2. Description of Related Art

The principal application for ferroniobium alloys (FeNb ISO 5453) is the production of high strength low alloy steels, in which the typical niobium content of the end product has a maximum of 0.10 wt % Nb. Stainless steels, however, such as UNS S30940, S30741, S31040, S31041, S31640, S33228, S34700, S34708, S34800, S34809, and the like, generally contain from about 0.60 to 0.80 wt % Nb. And nickel-based superalloys, such as Inconel 718, Inconel 625, Inconel 750, and the like, generally contain from about 0.70 to 5.50 wt % Nb. When substantially higher niobium contents are implicated, the contamination of the alloys with impurities such as lead may severely harm the hot ductility of the resulting steel or alloy. This ductility impairment can occur to such an extent that scrapping of the material due to the formation of deep cracks during the hot working operation, typically carried out on rolling mills or forges, may become a recurrent problem. Moreover, the high temperature properties, e.g., creep rupture and the like, can be severely impaired, and in some cases, especially in superalloys, the impurity content, e.g., lead and the like, may exceed the typical specification limits.

It is therefore desirable to produce niobium-based ferroalloys exhibiting a low content of elements harmful to the hot workability and high temperature properties of the material that will receive the niobium addition. Of these harmful elements, e.g., lead, tin, bismuth, and the like, lead is one of the most harmful of them all, in the quantities normally found in such ferroalloys.

A process commonly utilized to produce niobium-based ferroalloys from niobium ore concentrate, which generally has a lead content of about 50 ppm or less, is the basic chemical leaching process followed by calcination. During the chemical leaching step, lead is removed from the original ore concentrate, reacted with calcium chloride and thereby precipitated as lead chloride. After the concentrate goes through the leaching process and the lead chloride is precipitated, the material is filtered to separate the mineral from the liquid. The lead chloride that goes along with the ore concentrate is vaporized in a calcination furnace. The effluent gases are partly caught in the bag house of a dust collecting system, after which the gaseous mass goes through a water scrubber. This process however, has the potential of not being able to assure that all of the lead removed from the concentrate will be totally contained.

The present invention provides processes for removal of substantial amounts of lead and other impurities from niobium-based ferroalloys in a vacuum induction melting furnace.

SUMMARY OF THE INVENTION

This invention, in one embodiment, provides processes for producing low-lead, i.e., less than 20 ppm lead, niobium-based ferroalloys by means of processes which comprise: 1) charging niobium ore concentrate obtained by a combination of physical and/or chemical means which generally has a composition of about 60-70 wt. % niobium, $Fe_2O_3$, $SiO_2$, and $TiO_2$, less than 5 wt. % each, and BaO less than 25 wt. %, to a reactor suitable for conducting a metallothermic reaction. The niobium ore concentrate can be admixed with or replaced by niobium oxides, i.e., $Nb_2O_5$, $Nb_2O$, NbO or admixtures thereof; wherein the content of $Nb_2O_5$, $Nb_2O$, NbO or admixtures thereof in the overall ore concentrate/niobium oxide admixture can range from 0 to 100 wt. %; 2) The niobium ore concentrate and/or $Nb_2O_5$ are further admixed with a reducing agent such as aluminum, silicon, calcium, magnesium, and the like, and preferably, with an energy booster such as alkali metal perchlorates, peroxides, and the like; 3) other elements in their metallic or oxide form, such as chromium, molybdenum, cobalt, iron, and nickel, can also be added to the mixture, if desired. The metallothermic reaction is then initiated in an environment of reduced pressure, preferably, about 100 to 300 mbar, or, if desired, at atmospheric pressure. The benefit of the reduced pressure is to effect a reduction of any harmful impurities in the admixture to a level below that normally achieved and, in the specific case of lead, to a level below about 5 ppm when the metallothermic reaction is conducted under reduced pressure and coupled with further vacuum degassing effected in a vacuum induction melting furnace as described hereinbelow; 4) the reaction product is then solidified and cooled to permit safe handling either under reduced pressure or under normal atmospheric pressure, and 5) the solidified and cooled reaction product produced by the above process of the present invention can then be crushed and charged to a crucible placed within a vacuum induction melting chamber situated within a vacuum induction melting furnace. After the initial charging is completed, the chamber pressure is lowered to below 1 mbar and then, if desired, the chamber can be backfilled with an inert gas, such as argon, to about 100 mbar (to assist in maintaining a leak-free furnace), and power is applied to melt the load. During the meltdown of the charge, lead and other impurities, e.g., tin—are further removed in the gaseous state. Prior to the present invention, these vapors would condense and deposit on the furnace walls, crucible coils, etc. and spontaneously ignite when exposed to oxygen in the air, even in a rarified atmosphere.

In accordance with a further embodiment of the present invention, the resulting metallothermic reaction product can be crushed and charged to a crucible within a vacuum induction melting chamber, the pressure within the chamber is reduced to below 1 mbar, and, if desired, the chamber can be backfilled with an inert gas to about 100 mbar, and then power is applied to the system and said reaction product is melted while vaporizing impurities contained therein, the vaporized impurities are condensed upon the exposed surface of a cooled, condensing plate adapted to be brought into the vacuum induction melting chamber and positioned above the crucible and, upon completion of the melting process, removing said plate from the chamber with the condensed impurities thereon under vacuum, controllably oxidizing the condensed impurities, and recovering the reaction product having a lead content of 20 ppm or less.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
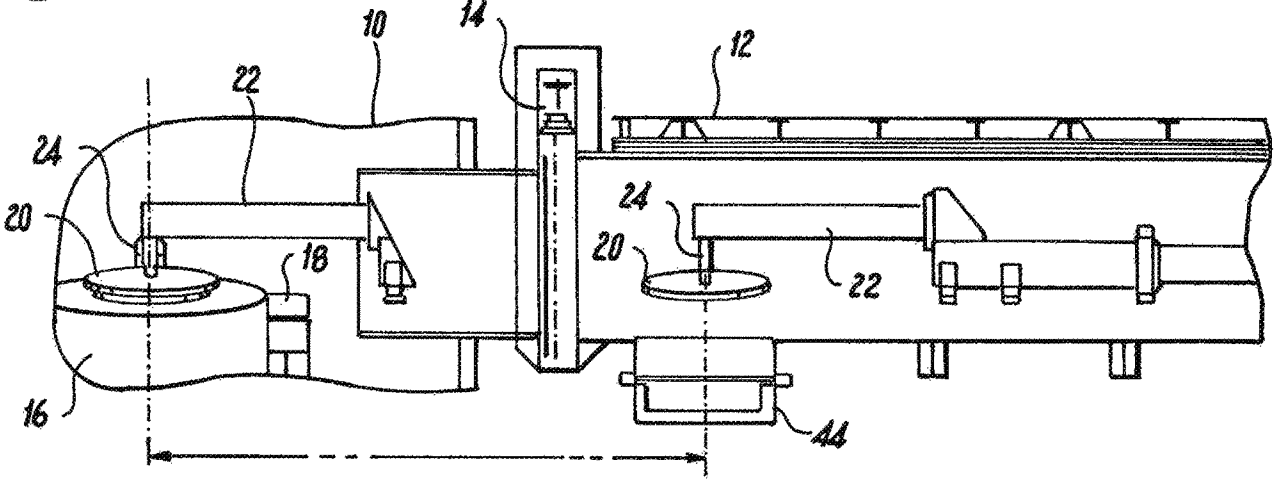
FIG. 1 is a partial side view of a schematic representation illustrating one embodiment of the system for translating the condensing plate between the crucible in the vacuum induction melting chamber and an oxidizing chamber.

Reference will now be made to the drawings wherein like reference numerals identify similar structural features or aspects of the subject disclosure. For purposes of explanation and illustration, and not limitation, a partial view of an exemplary embodiment of a vacuum induction melting chamber in accordance with the disclosure is shown in FIG. 1 and is designated generally by reference character 10. Other embodiments of vacuum induction melting chambers in accordance with the disclosure, or aspects thereof, are provided in FIGS. 2-3, as will be described.

As shown in FIG. 1, a vacuum induction melting chamber 10 situated within a vacuum induction melting furnace (not shown) is connected to an adjacent oxidizing chamber 12 via an isolation valve 14 situated therebetween. A crucible 16 is seated within a rotatable cradle 18 within the vacuum induction melting chamber 10. The rotatable cradle 18 is adapted to tilt the crucible 16 to enable discharge of the molten metal upon completion of the melting operation and by back tilting the crucible, during the melting operation, increasing the surface area of the melt thereby increasing the efficiency of the removal of the vaporized impurities therein. Back tilting of the crucible also avoids bridging at the top of the charge. Bridging is a safety hazard which can cause explosions. A condensing plate 20 is situated above the refractory crucible 16 and is adapted to translate into and out of the vacuum induction melting chamber 10 passing through the isolation valve 14 and into the oxidizing chamber 12. The condensing plate 20, preferably a water-cooled metallic condenser made of copper or stainless steel, is affixed, in one embodiment, to a carriage assembly 22 which permits the condensing plate 20 to translate between the vacuum induction melting chamber 10, passing through the isolation valve 14, to the oxidizing chamber 12. The carriage assembly 22 effects translation of the condensing plate 20 by way of a hydraulically driven piston, a revolving screw-driven arrangement, or the like.

When the condensing plate 20 is within the chamber 10, it is positioned spaced above the refractory crucible 16. Means 24 are provided for attaching the condensing plate 20 to the carriage assembly 22 and to permit ingress and egress of coolant to condensing plate 20.

The isolation valve 14 which connects the chamber 10 and the oxidizing chamber 12 permits the condenser 20 to pass therethrough while providing means for maintaining a vacuum in both the chamber 10 and the oxidizing chamber 12 and yet permitting the furnace and the condensing chamber to operate independently of each other to permit discharge of the melt from the furnace and controlled oxidation of the impurities condensed on the condenser when the condenser is in the oxidizing chamber.

In operation, niobium ore concentrate, in powder or granular form, e.g., generally less than about 2 mm. thick, is optionally mixed with or replaced by niobium oxide and further admixed with a reducing agent such as aluminum and an energy booster such as potassium perchlorate. Other metals or metallic oxides can also be added to the mixture such as nickel, chromium, molybdenum, cobalt, iron, and/or their oxides. The resulting mixture is charged to a metallothermic reactor which optionally can be placed in a vacuum chamber. In a preferred embodiment, the charged metallothermic reactor is placed within a vacuum chamber enabling the production of higher quality niobium-based ferroalloys. The metallothermic reaction is ignited, preferably under reduced pressure. Upon completion of the reaction, the resulting alloy is allowed to solidify and cool to a point where it can be safely handled. The resulting alloy is discharged from the reactor and crushed and then charged to the melting crucible 16 within the vacuum induction melting chamber 10. If desired, rather than employ the alloy resulting from the metallothermic reaction described herein, the alloy resulting from conventional reduction of niobium ore concentrate in open air can be employed instead. Once the alloy, regardless of how produced, is charged to melting crucible 16, the condenser 20 is translated to a position above the melting crucible 16 within the vacuum induction melting chamber 10. Water-cooling of the condenser is initiated by circulating cold water or other coolant through the condenser. The pressure within the vacuum induction melting chamber 10 and the adjacent oxidizing chamber 12 is lowered to below 1 mbar. An inert gas can be introduced, if desired, to backfill the chamber and the adjacent oxidizing chamber to a pressure up to about 100 mbar, and the power is applied to melt the load.

Figure 2:
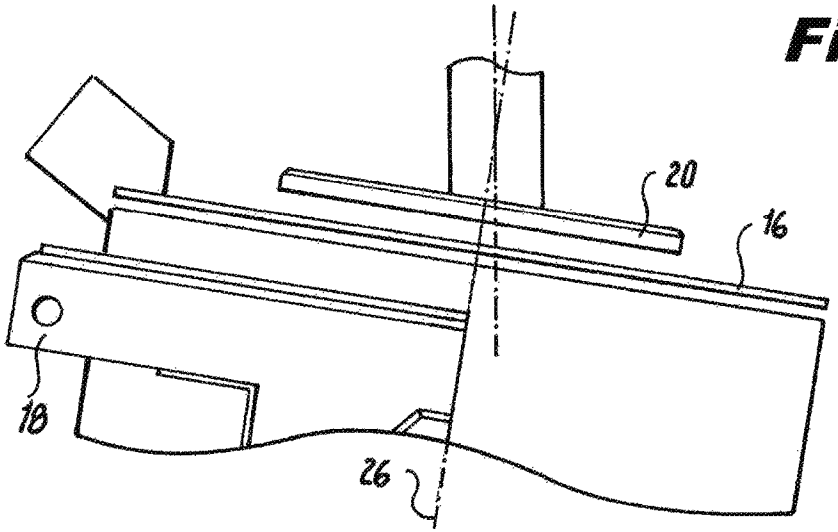
FIG. 2 is a partial side view of a schematic representation of one embodiment of the present invention illustrating the relationship between the crucible in the vacuum induction melting chamber and the condenser.

As shown in FIG. 2, the refractory crucible 16 is adapted to be rotated off its vertical axis 26 or back tilted along with the condenser 20. In this manner, the exposed surface area of the resulting melt is increased, enhancing removal of the volatile impurities and bridging at the top of the charge is prevented. The volatile elements, including lead, are quickly and preferentially condensed on the surface of the cooled condenser 20 rather than contaminating the furnace interior. Upon completion of the melting process, the condenser 20, with the condensed impurities thereon, is withdrawn from the melting chamber and translates into the adjacent oxidizing chamber 12 through isolation valve 14, while maintaining reduced pressure throughout the entire system. Once the condenser is withdrawn into the adjacent oxidizing chamber, the isolation valve 14 is closed, an oxidizing gas such as air, oxygen, or a mixture of oxygen and an inert gas such as argon, or the like, is gradually introduced at a controlled rate into oxidizing chamber 12 promoting oxidation of the condensed impurities in a manner that does not present a safety hazard to the environment and personnel. In order to ensure that no condensed metallic impurities will be oxidized prematurely when the condenser is withdrawn from the melting crucible and passed from the vacuum induction melting chamber into the adjacent oxidizing chamber 12, no air is permitted to enter the oxidizing chamber 12, until after the isolation valve is closed. It is considered preferable that the vacuum induction melting furnace be constructed in an essentially leak-free configuration as discussed below.

Figure 3:
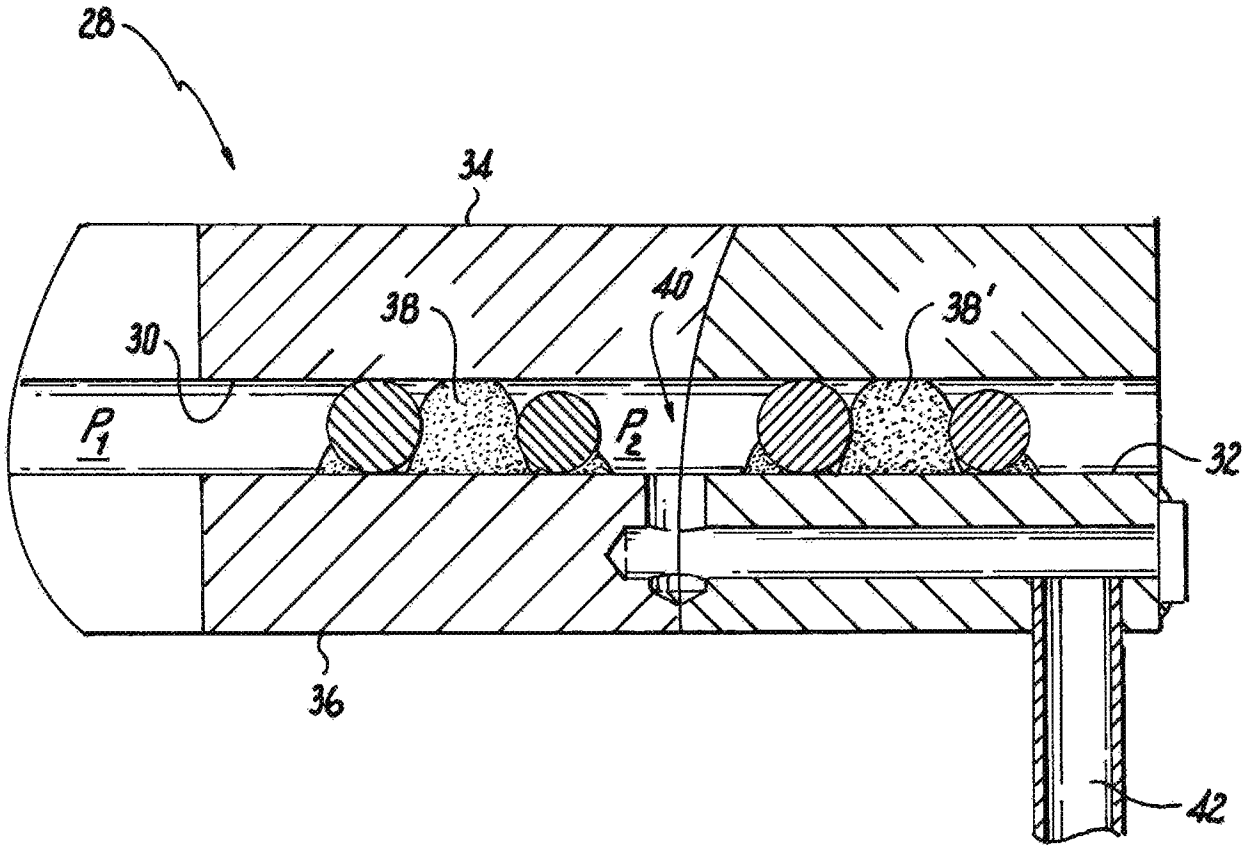
FIG. 3 is a partial cross section of the double vacuum seal arrangement which, in one embodiment of the present invention, can be used in the vacuum induction melting furnace to create an essentially leak-free environment.

As shown in FIG. 3, in order to insure an essentially leak-free configuration, all sealing surfaces of the vacuum induction melting furnace 28, such as sealing surfaces 30 and 32 of the access port to the vacuum induction melting furnace 28 are equipped with a double vacuum sealing arrangement about the perimeter of the furnace between the lid 34 and body 36 of the furnace 28. Two compressible sealing elements 38 and 38' are compressed along the perimeter between the lid 34 and the body 36 of the furnace 28. When a vacuum is being drawn in the furnace, the space 40 between sealing elements 38 and 38' is also independently evacuated via conduit 42 connected to a vacuum pump (not shown) to a pressure ($P_2$) lower than the pressure ($P_1$) inside the furnace. In this manner, a reduced pressure environment is maintained within the furnace throughout the process essentially preventing the infiltration of the external atmosphere and also serving as an early warning system for a potential leak hazard at the interface between the lid 34 and body 36 of the vacuum induction melting furnace 28.

If desired, the resulting niobium-based ferroalloy may be retained for an additional period of time under reduced pressure in the vacuum induction melting furnace to achieve further refining. The final lead content of the ultimate niobium-based ferroalloy can be reduced in this fashion to 0.0020 wt. % or lower, i.e., 20 ppm or lower, if the metallothermic reaction is conducted at atmospheric pressure, and, to less than 5 ppm, if the reaction is conducted under reduced pressure.

Once the controlled oxidation of the condensed impurities is completed, the impurities, in the form of a dust of mixed oxides of the metallic impurities, can be removed from the adjacent oxidizing chamber 12 and collected in dust collector 44 for safe disposal.

EXAMPLES

Example 1—Production of Refined Ferroniobium Alloy

The following example illustrates the effectiveness of the present invention in reducing the lead content of ferroniobium alloys to 20 ppm or less.

Ferroniobium, obtained by an aluminothermic reduction reaction and having a lead content of 0.075 wt %, is charged to the melting crucible of an essentially leak proof vacuum induction melting chamber. A copper, water-cooled condenser is situated within the vacuum induction melting furnace and is adapted to translate between the furnace and an adjacent oxidizing chamber through an isolation valve forming the interface between the furnace and the oxidizing chamber, whereby the condenser can be positioned over the melting crucible. The condenser is also adapted to rotate with the melting crucible while maintaining the reduced pressure throughout the system. Once the ferroniobium alloy is charged to the melting crucible, the condenser is moved over to a position above the melting crucible, water cooling of the condenser is initiated, the chamber pressure in the vacuum induction melting furnace is lowered to 0.1 mbar and then backfilled with argon to 100 mbar. Power is then applied to the induction coils to melt the charge. The temperature within the furnace is maintained at 1600° C. The furnace, with the condenser spaced above the crucible, can be tilted, if desired, to maximize the surface area of the melt. Periodically, samples are withdrawn from the system and analyzed for lead content. The following table summarizes the results.

| Time After Complete Meltdown of Charge | Temperature (° C.) | Pb % wt |
|---|---|---|
| Original Material | — | 0.075 |
| 0.33 hr | 1600 | 0.016 |
| 1 hr | 1600 | 0.003 |
| 2 hr | 1600 | 0.001 |

The vacuum induction melting procedure results up to 99 wt % removal of lead and other impurities from the ferroniobium alloy. The vaporized lead and other impurities condense on the exposed surface of the cooled copper condenser. While maintaining the reduced pressure, the condenser is retracted from the crucible and passed through the isolation valve into the adjacent oxidizing chamber. Once the isolation valve is closed, the furnace can be tapped and the melt discharged from the crucible into solidification molds. Then the isolation valve 14 is closed and, in a controlled manner, oxygen or a mixture of oxygen and an inert gas is permitted to enter the oxidizing chamber effecting oxidation of the lead and other impurities without causing serious fire or explosion. A powdery dust of metallic oxides of the impurities resides within the chamber, whereupon, a stream of inert gas, e.g., argon or the like, is admitted to the chamber under the influence of the reduced pressure in the system, effectively dislodging and removing the dust to collection means such as a collection bag or container, without creating a safety hazard.

Example 2—Production of Refined Niobium-Based Ferroalloy Containing Nickel

The following example illustrates the effectiveness of the present invention in reducing the lead content of niobium-based alloys containing nickel to 20 ppm or less.

A blend of ferroniobium (ISO 5453) together with NiNb is charged to a melting crucible sealed within a vacuum induction melting furnace made essentially leak proof in the manner shown in FIG. 3. As in Example 1, a copper, water-cooled condenser translates from an adjacent oxidizing chamber through an isolation valve and is positioned over the melting crucible. The condenser is also adapted to translate from its position over the melting crucible and to pass through the isolation valve back into the adjacent oxidizing chamber, while maintaining the reduced pressure throughout the system. Once the ferroniobium alloy together with NiNb is charged to the melting crucible, the condenser is positioned over the melting crucible, water cooling of the condenser is initiated, the chamber pressure in the vacuum induction melting furnace and the adjacent oxidizing chamber is lowered to 0.1 mbar and backfilled with argon to 100 mbar, and then the power is applied to the induction coils to melt the charge. The temperature within the furnace is maintained at 1,600° C. Periodically, samples are withdrawn from the system and analyzed for lead content. The following table summarizes the results.

| Time After Complete Meltdown of Charge | Temperature (° C.) | Pb % wt |
|---|---|---|
| Original Material | 1,600 | 0.075 |
| 0.33 hr | 1,600 | 0.016 |
| 1 hr | 1,600 | 0.003 |
| 2 hr | 1,600 | 0.001 |

The vacuum induction melting procedure results in extensive removal of lead from the resulting ferroniobium nickel alloy. The vaporized lead and other impurities preferentially condense on the exposed surface of the cooled copper condenser. While maintaining the reduced pressure, the condenser is retracted from its position over the crucible and passed through the isolation valve into the adjacent oxidizing chamber. Once the isolation valve is closed, the charge is tapped into solidification molds and then the vacuum can be broken and the molds withdrawn from the furnace. Then, the isolation valve is closed and, in a controlled manner, an oxidizing mixture of argon and oxygen is permitted to enter the adjacent oxidizing chamber effecting oxidation of the lead and other impurities without causing serious fire or explosion. A powdery dust of metallic oxides of the impurities resides within the chamber, whereupon, a stream of inert gas, e.g., argon or the like, is admitted to the chamber with the aid of the reduced pressure in the system, effectively dislodging and removing the dust to collection means such as a collection bag or container, without creating a safety hazard.

In the same manner, the nickel can be replaced with iron, chromium, cobalt, and the like to obtain the corresponding niobium-based ferroalloys containing the foregoing elements or mixtures thereof.

Example 3—Production of Ferroniobium Nickel Alloy

A mixture of Nb-ore concentrate, $Nb_2O_5$, nickel, $KClO_4$ energy booster, and metallic aluminum powder are charged to a reactor in a vacuum chamber. A vacuum is drawn to about 100 mbar and an aluminothermic reaction is initiated. After the reaction is completed, the material is allowed to solidify and cool to a temperature compatible with safe handling. The pressure is then allowed to return to atmospheric pressure and the crucible is removed from the vacuum chamber. The resulting ferroniobium nickel alloy is removed from the crucible, cleaned and crushed.

The resulting ferroniobium-nickel alloy is then charged to a melting crucible in a vacuum induction melting furnace and melted therein as in Example 1 to remove substantially all the remaining lead and other impurities. In this manner, the lead content in the resulting alloy is less than 5 ppm.

Example 4—Production of Ferroniobium Nickel Alloy

A mixture of ferroniobium, refined niobium oxide, $KClO_4$ temperature booster, nickel, and aluminum powder is charged to a crucible in a vacuum chamber. A vacuum is drawn and an aluminothermic reaction is initiated. Upon completion of the reaction, the resulting ferroniobium nickel alloy is recovered, cleaned and charged to a vacuum induction melting furnace and remelted therein as in Example 1 to remove substantially all of the remaining lead and other impurities.

What is claimed is:

1. A process for producing low-lead niobium-based ferroalloys comprising:

charging niobium ore concentrate to a metallothermic reaction chamber;

admixing the ore concentrate with a reducing agent;

reducing the pressure in the reaction chamber to below atmospheric pressure;

initiating a metallothermic reaction; and recovering a reaction product by allowing the reaction product to solidify and cool.

2. The process as recited in claim 1, wherein an energy booster is added to the resulting admixture prior to the metallothermic reaction.

3. The process as recited in claim 1, wherein one or more elements selected from the group consisting of chromium, molybdenum, cobalt, iron, and nickel, oxides of any of the foregoing, and mixtures thereof is added to the admixture prior to the metallothermic reaction.

4. The process as recited in claim 1, wherein the metallothermic reaction is conducted under a reduced pressure ranging from 100 to 300 mbar.

5. The process as recited in claim 1, wherein the niobium ore concentrate is admixed with or replaced by $Nb_2O_5$, $Nb_2O$, NbO or an admixture thereof.

6. The process as recited in claim 1, further comprising:

crushing the reaction product;

charging the crushed product to a melting crucible within a vacuum induction melting furnace;

lowering the pressure within the furnace to below 1 mbar;

applying power to the system and melting said crushed product while vaporizing the impurities contained therein, condensing the vaporized impurities upon the exposed surface of a cooled condensing plate adapted to be positioned above the crucible;

removing said plate with the condensed impurities thereon from the furnace under vacuum;

controllably oxidizing the condensed impurities; and recovering the resulting alloy product having a lead content of 5 ppm or less.

7. The process as recited in claim 6, wherein after the pressure within the furnace is lowered to below 1 mbar, the pressure within the furnace is backfilled with an inert gas to bring pressure up to about 100 mbar.

8. The process as recited in claim 7, wherein the condenser plate is a metallic, water cooled condenser.

9. The process as recited in claim 8, wherein the condenser plate is a copper condenser.

10. The process as recited in claim 6, wherein once the impurities have been substantially removed from the melt, removing the condensing plate with the condensed impurities thereon from the furnace, and passing the condensing plate through an isolation valve situated between the vacuum induction melting furnace and an adjacent oxidizing chamber, while the furnace and oxidizing chamber are under vacuum, closing the isolation valve, and admitting an oxidizing agent or mixture into the oxidizing chamber in a controlled manner to oxidize the condensed impurities, and converting the impurities to a removable oxide dust.

11. The process as recited in claim 10 wherein once oxidation is completed, a stream of inert gas is admitted to the oxidizing chamber to dislodge and safely remove the oxide dust to an external dust collector.

12. A process for producing low-lead niobium-based ferroalloys comprising:

crushing niobium ferroalloy previously having been reduced in open air;

charging the crushed product to a melting crucible within a vacuum induction melting furnace;

lowering the pressure within the furnace to below 1 mbar;

applying power to the system and melting said crushed product while vaporizing impurities contained therein;

condensing the vaporized impurities upon the exposed surface of a cooled condensing plate adapted to be positioned above the crucible;

removing said plate with the condensed impurities thereon from the furnace under vacuum;

controllably oxidizing the condensed impurities; and recovering the resulting alloy product having a lead content of 20 ppm or less.

13. The process as recited in claim 12, further comprising, after the pressure within the furnace is lowered to below 1 mbar, backfilling the pressure within the furnace with an inert gas to bring pressure up to about 100 mbar.

14. The process as recited in claim 13, wherein the condenser plate is a metallic, water cooled condenser.

15. The process as recited in claim 14, wherein the condenser plate is a copper condenser.

16. The process as recited in claim 12, further comprising, once the impurities have been substantially removed from the melt, removing the condensing plate with the condensed impurities thereon from the furnace, and passing the condensing plate through an isolation valve situated between the vacuum induction melting furnace and an adjacent oxidizing chamber; while the furnace and oxidizing chamber are under vacuum, closing the isolation valve, and admitting an oxidizing agent or mixture into the oxidizing chamber in a controlled manner to oxidize the condensed impurities; and converting the impurities to a removable oxide dust.

17. The process as recited in claim 16, further comprising, once oxidation is completed, admitting a stream of inert gas to the condensing chamber to dislodge and safely remove the oxide dust to an external dust collector.

18. The process as recited in claim 6, wherein the resulting alloy product includes a lead content of 2 ppm or less.

* * * * *